United States Patent [19]

Tavernier et al.

[11] Patent Number: 4,842,972

[45] Date of Patent: Jun. 27, 1989

[54] PROCESS FOR IMAGE PRODUCTION CONTAINING THE HEAT-AND-PRESSURE FIXING OF A STILL WET OR MOIST TONER IMAGE

[75] Inventors: Serge M. Tavernier, Lint; William C. Waterschoot, Belsele; Robert T. Overmeer, Mortsel, all of Belgium

[73] Assignee: Agfa-Gevaert N.V., Mortsel, Belgium

[21] Appl. No.: 49,994

[22] Filed: May 15, 1987

[30] Foreign Application Priority Data

May 29, 1986 [EP] European Pat. Off. ..... 86200930.5

[51] Int. Cl.[4] ..... G03G 9/16

[52] U.S. Cl. ..... 430/117; 430/119

[58] Field of Search ..... 430/118, 119, 99, 100; 355/10; 118/651

[56] References Cited

U.S. PATENT DOCUMENTS

| | | | |
|---|---|---|---|
| 3,820,987 | 6/1974 | Wells et al. | 430/126 |
| 4,375,505 | 3/1983 | Newkirk | 430/99 |
| 4,504,138 | 3/1985 | Kuehnle | 430/119 |
| 4,639,405 | 1/1987 | Franke | 430/99 |

*Primary Examiner*—John L. Goodrow

*Attorney, Agent, or Firm*—William J. Daniel

[57] ABSTRACT

In a process of image production by the steps of developing an electrostatic charge pattern with toner particles comprised of coloring matter in a thermoplastic resin binder and dispersed in a carrier liquid and fixing the pattern-wise deposited toner particles while still damp with said carrier liquid on a support by simultaneously subjecting the same to heat and pressure, the toner particles have at 120° C. a melt viscosity when dry of from 500 to 100,000 Pa.s, a mean average diameter of from 0.1 to 5 μm, and a ratio of coloring matter to resin binder of from 1/1 to 1/9 by weight.

14 Claims, 2 Drawing Sheets

Figure 1:
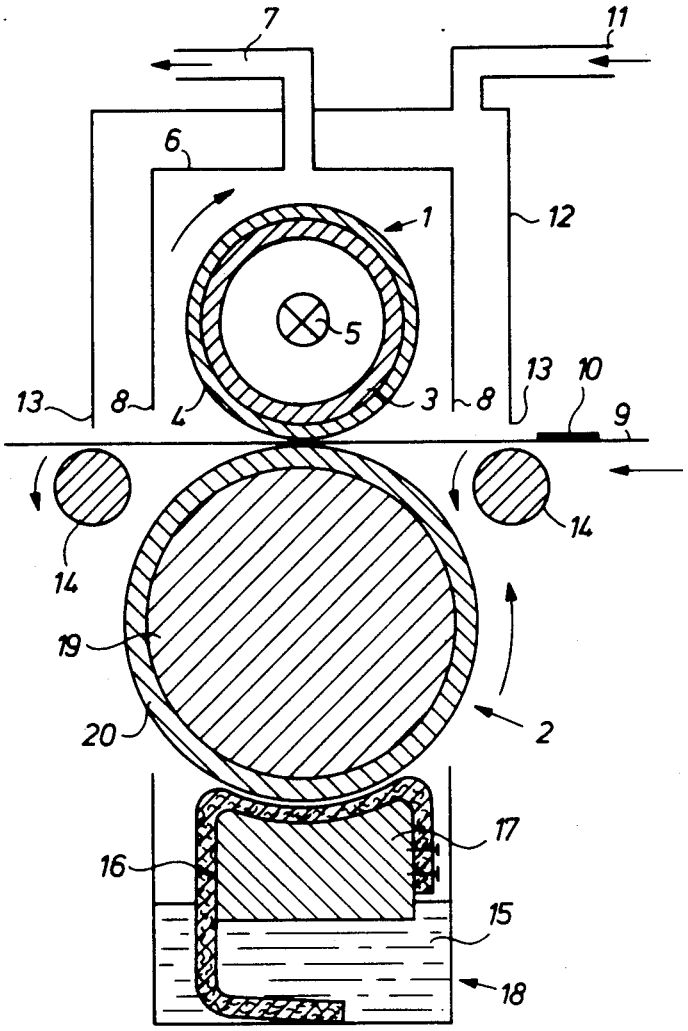

PROCESS FOR IMAGE PRODUCTION CONTAINING THE HEAT-AND-PRESSURE FIXING OF A STILL WET OR MOIST TONER IMAGE

The present invention relates to a process of image production by developing an electrostatic charge pattern with a liquid developer and fixing the obtained image.

The formation of a latent electrostatic charge image on the surface of a photoconductive member and its later development is well known to the art. A survey of different methods for the production of electrostatic charge patterns on photoconductive electrically insulating recording materials and non-photoconductive electrically insulating recording materials is given e.g. in U.S. Pat. No. 4,130,670.

The development of the latent electrostatic image proceeds by depositing thereon finely divided coloured particulate material, called toner particles. The toner particles have a definite electric charge sign and are attracted by a charge pattern of opposite charge sign in proportion to the field strength of the respective incremental areas defining the pattern.

In "direct" electrophotography the toned image is fixed or fused to the photoconductive surface as by heat or other suitable means whereas in "indirect" electrophotography the toned image is transferred to a secondary support medium such as paper and fixed thereon.

The latent charge image may be made visible by a so-called dry development method using dry electrically charged toner particles, whether or not in admixture with carrier particles, or it may proceed by a so-called wet development method employing of a suspension of electrically charged pigment particles in an insulating carrier liquid.

The development with dry toner particles is normally followed by a fixing process based on a treatment with solvent-vapour or with heat resulting in fusing of the toner particles. There are three generally known types of fusing processes used for fixing a dry toner powder image to its support. The first is an oven heating process in which heat is applied by hot air and/or infra-red radiation over a wide portion of the support sheet, the second is a flash heating process in which heat is produced in the toner by absorption of light energy emitted by a flash lamp and the third is a pressure heating process wherein the support with the toner image is simultaneously pressed and heated.

In a common heat and pressure fusing process described e.g. in U.S. Pat. No. 4,269,594 and 4,478,923 the support carrying the non-fixed dry toner image is conveyed through the nip formed by a fuser roller aso called heating roller and an other roller backing the support and functioning as pressure exerting roller but optionally also as heating roller. Such fixing has to proceed in a rather narrow temperature range to avoid degradation of the image quality.

If the fuser roller applies too much thermal energy to the toner and paper the toner will melt to a point where its viscosity is so low that "splitting" can occur, and some of the toner is transferred to the fuser roller giving rise to the phenomenon called "hot offsetting". This occurs when the toner particles are picked up by the fuser roller when there is inadequate release (cleaning). Such release is commonly provided by wetting the fuser roller with silicone oil. When splitting does occur the toner which is taken up by the fuser roller is usually transferred to the next copy sheet, giving rise to smudging.

If too little thermal energy is provided then the toner particles may fuse together but not effectively to the paper, especially since the thermal energy is delivered through the toner. Likewise in this case some of the toner particles can be transferred to the fuser roller giving rise to the phenomenon called "cold offsetting". The unreleased toner particles will again be deposited onto the next copy sheet resulting in smudging.

In both cases some toner will be transferred to the pressure roller during the interval between subsequent paper feedings.

Moreover, too cold transfer to the paper results in poor fix.

In order to prevent as much as possible the above described toner offset, the fuser roller is coated with an abhesive, i.e. adhesion inhibiting, material such as silicone rubber and silicone oil or is provided with a smooth coating of polytetrafluoroethylene resin having a very low friction coefficient and low adhesivity to hydrophobic materials. Although such coating prevents toner offset to a certain extent, a completely satisfactory solution to the problem cannot be achieved unless the properties of the toner are carefully selected within proper ranges.

In wet development the suspended electrically charged toner particles migrate through the carrier liquid under the influence of the electric field originating from the electrostatic charge pattern. In positive-positive development they deposit onto the non-exposed charged area of the photoconductive recording element and in reversal development they deposit onto the exposed area wherein a charge is created by fringe effect or induction through a developing electrode (ref. R. M. Schaffert "Electrophotography" The Focal Press—London, New York, enlarged and revised edition 1975, p. 50–51 and T. P. Maclean "Electronic Imaging" Academic Press—London, 1979, p. 231).

The migration of charged suspended toner particles through a liquid by an electric field is called electrophoresis and the liquid developer applied in said development technique is called an electrophoretic developer.

Electrophoretic development proceeds by contacting the recording element with liquid electrophoretic developer whereby said recording element finally carries a large amount of carrier liquid. The carrier liquid used in electrophoretic development is a non-polar liquid, e.g. hydrocarbon liquid that by transfer of the toner particle image onto the receiving element, e.g. paper, is adsorbed and/or absorbed thereby and finally removed by evaporation upon heating. Normally the evaporated carrier liquid is escapes into the atmosphere which creates a risk of fire together with a serious pollution of the environment.

As described e.g. in U.S. Pat. No. 4,161,453 electrophoretically formed toner images are while still wet with carrier liquid by heating the support carrying the toner image. According to one embodiment described in said United States Patent Specification the heating proceeds by flash exposure.

The last mentioned heating process consumes large amount of energy consuming and requires costly equipment. Moreover, the operation of a flash lamp is noisy and the human eye has to be shielded against its blinding action.

The present invention is based on our research into the problem of using a heat and pressure roller system in fixing electrophoretically developed toner images, and our discovery that by careful selection of the properties of the toner, an economic and reliable fixing can be achieved.

In this respect we have established experimentally that a proper melt viscosity range of the toner particles applied in liquid development and a proper ratio by weight of colouring matter to binder resin offers the possibility of a strong fixing without image deterioration. The melt viscosity determines the temperature at which the fixation occurs, whereas the ratio of colouring matter versus binder resin mainly influences the cohesivity of the molten toner particles reducing the risk of splitting and offsetting as described above in relation to dry toner development and fixing.

It is an object of the present invention to provide an economical and reliable fixing process for the fixing of still wet or moist electrophoretically deposited toner particles.

Other objects and advantages will become apparent from the following description.

In accordance with the present invention there is provided a process of image production, which comprises the steps of developing an electrostatic charge pattern with toner particles comprising colouring matter in a thermoplastic resin binder and dispersed in a carrier liquid and fixing the still wet or moist patternwise deposited toner particles on a support simultaneously subject the same to heat and pressure, characterized in that said toner particles and have at 120° C. à melt viscosity in a dry state of from 500 to 100,000 Pa.s, a mean average diameter of from 0.1 to 5 μm, preferably 0.5 to 2 μm, and a content of colouring matter to resin binder of from 1/1 to 1/9 by weight.

By the process of the present invention drying and fixing of the wet toner image proceed in one step.

It is surprising that a heat and pressure roller fixing system has not hitherto been applied industrially in the fixing of still wet or moist toner images, especially in view of the advantages which such a system affords. Amongst these advantages may be cited simplicity of heating equipment and economical operation while enabling the avoidance of toxic vapours due to decomposition of toner polymer and of scorching the support material.

The melt viscosity of the toner has been measured with a RHEOMETRICS RVE-M (trade name of Rheometrics, Inc. 2438 U.S. Highway No. 22 Union, N.J., 07083, U.S.A.) viscosimeter containing two parallel rotatable disks with a diameter of 25 mm and spaced apart by a gap of 1 to 2 mm wherein the toner is arranged. The measurement of the melt viscosity proceeds by applying an oscillatory movement to the upper disc and measuring the mechanical coupling towards the lower disc which is linked to a transducer converting the resulting torsion values into Pa.s. The oscillatory movement proceeds at an angular frequency of 100 rad/s and with amplitude of 1% strain. The measurement is done after 5 minutes of thermal equilibration at 120° C. Before being introduced between said discs the toner particles are separated from their carrier liquid by centrifuging, then washed with fresh carrier liquid and dried.

In the toner particles for use according to the present invention the colouring matter is dissolved or dispersed in a binder essentially consisting of a thermoplastic polymer or blend of such polymers wherein the polymer(s) may be partially crosslinked so that they still may be considered as being thermoplastic elastomers.

Suitable polymers for use as said binder are e.g. resins belonging to the class of thermoplastic polyallyl resins, polyvinyl resins, polyalkylenes, polysiloxane resins, also called silicone elastomers, and polyester resins, said resins having a softening temperature in the range of 80° C. to 150° C.

Examples of suitable polyallyl resins are allyl alcohol-styrene copolymers and allyl alcohol ester-styrene copolymers described by Schildknecht in "Allyl Compounds and their Polymers" Vol. 28, p. 204–206, (1973) J. Wiley & Sons, Interscience Publishers. The preparation of partial fatty acid esters of styrene-allyl alcohol copolymers by either a fusion cook or by an azeotropic cooking procedure is described in Technical Service Bulletin "RJ-100" for solvent-based vehicles (1963) of Monsanto.

Examples of suitable polyvinyl resins are:

(a) Ethylenically unsaturated carboxylic acid esters having in the ester group $C_1$–$C_4$ alkyl, $C_1$–$C_4$ haloalkyl, $C_1$–$C_4$ alkoxyalkyl, $C_1$–$C_4$ acylalkyl, $C_1$–$C_4$ cyanoalkyl, aralkyl, aryl or substituted aryl;

(b) ethylenically unsaturated carbonitriles, (c) ethylenically unsaturated carbonamides and N-substituted carbonamides, e.g. $C_1$–$C_4$ alkyl or $C_1$–$C_4$ haloalkyl substituted carbonamides, (d) halogenated aliphatically unsaturated hydrocarbons, e.g. vinyl chloride and vinylidene chloride, (e) styrene, methylstyrene, methoxystyrene and halogenated styrene, (f) vinyl alkyl ethers having from 1 to 4 carbon atoms in the alkyl group, (g) vinyl ketones having an alkyl group of at most 4 carbon atoms, (h) vinyl alcohol esters of aliphatic, araliphatic, aromatic or heterocyclic acids wherein alkyl, if present, is $C_1$–$C_4$ alkyl, (i) vinyl acetals, e.g. polyvinyl butyral, and (j) N-vinyl pyrrolidinone, and copolymers of the above vinyl monomers.

Other suitable resins are polyester resins suited for use in the production of toner particles for heat-and-pressure fixing of dry toners as described in U.S. Pat. No. 4,478,569.

In admixture with these resins other resins or pigments modifying the melt-viscosity may be used and/or release agents assisting in the release of the toner melt from the fuser roller. Particularly suited for that purpose are abhesion promoting compounds, e.g. talcum, silicones, fluor containing polymers and natural or synthetic waxes.

Suitable fluoro-containing vinyl polymers having a particularly low friction coefficient (static friction coefficient with respect to steel below 0.2) for preventing toner offsetting on the fuser roll are described in U.S. Pat. No. 4,059,768.

Particularly suitable for preventing toner-offsetting are waxy polyalkylene resins, more particularly an isotactic polypropylene having an average molecular weight of 14,000.

The colouring matter used in toner particles applied according to the present invention is e.g. an organic pigment dye or inorganic pigment, the inorganic pigment including carbon.

Pigments having a density ($g.cm^{-3}$) larger than 1.8 are advantageously used to bring the melt viscosity in the desired range. Pigments suitable for that purpose are e.g. titanium dioxide (rutile) having a density of 4.26, barium sulphate (barite) having a density of 4.5, ferric oxide ($Fe_2O_3$=hematite) and ferrosoferric oxide ($Fe_3O_4$=magnetite) having respectively a density of 5.24 and 5.18 (ref. Handbook of Chemistry and Physics, 42nd ed., published by The Chemical Rubber Publishing Co., 2310 Superior Ave. N.E. Cleveland, Ohio—U.S.A.)

The latter two pigments serve also as colouring substance e.g. in magnetic toners. Therefore, the present invention includes the use of toners wherein magnetic pigment serves wholly or partially as the colouring substance.

For preparing liquid toner compositions used for producing black images preferably carbon black is used as colouring matter. For example, lamp black, channel black, and furnace black e.g. SPEZIALSCHWARZ IV (trade-name of Degussa Frankfurt/M, W. Germany) and VULCAN XC 72 (trade name of Cabot Corp. High Street 125, Boston, U.S.A.) described more in detail in U.S. Pat. No. 4,271,249.

The characteristics of preferred carbon blacks are listed in the following table 1.

TABLE 1

| | SPEZIALSCHWARZ IV | VULCAN XC 72 |
|---|---|---|
| origin | channel black | furnace black |
| density at 20° C. | 1.8 g × $cm^{-3}$ | 1.8 g × $cm^{-3}$ |
| grain size before entering the toner | 25 nm | 29 nm |
| oil number (g of linseed oil adsorbed by 100 g of pigment) | 300 | 225 |
| specific surface (sq. m per g) | 120 | 190 |
| volatile material (% by weight) | 12 | 2 |
| pH | 3 | 8.5 |
| colour | brown-black | brown-black |

For the production of coloured images preferably organic pigment dyes are used in admixture with the already mentioned thermoplastic resin binder.

Suitable organic pigment dyes are: phthalocyanine dyes, e.g. copper phthalocyanines, metal-free phthalocyanines, azo dyes, and metal complexes of azo dyes.

The following dyes in pigment form are given for illustration purposes only: FANALROSA B Supra Pulver (trade name of Badische Anilin & Soda-Fabrik AG, Ludwigshafen, Western Germany, HELIOGEN-BLAU LG (trade name of BASF for a metal-free phthalocyanine blue pigment), MONASTRAL BLUE (a copper phthalocyanine pigment, C.I. 74,160). HELIOGENBLAU B Pulver (trade name of BASF), HELIOECHTBLAU HG (trade name of Bayer AG, Leverkusen, Western Germany, for a copper phthalogyanine C.I. 74,160), BRILLIANT CARMINE 6B (C.I. 18,850), and VIOLET FANAL R (trade name of BASF, C.I. 42,535).

Typical inorganic pigments for the production of black or coloured images include black iron(III) oxide and mixed copper(II) oxide/chromium(III) oxide/iron(III)oxide powder, milori blue, ultramarine cobalt blue, and barium permanganate. Further can be mentioned: the pigments described in the French Patent Specifications Nos. 1,394,061 and 1,439,323.

In electrophoretic developers the toner particles are dispersed in an apolar carrier liquid having at 20° C. a dielectric constant less than 3 and a volume resistivity of at least $10^9$ ohm.cm.

The carrier liquid is preferably a non-aromatic hydrocarbon liquid, e.g. an aliphatic hydrocarbon such as hexane, cyclohexane, iso-octane, heptane or isododecane, a fluorocarbon or a silicone oil or mixtures thereof. Thus, the insulating non-polar liquid is e.g. isododecane or a commercial petroleum distillate, e.g. a mixture of aliphatic hydrocarbons having a boiling range preferably between 150° C. and 220° C. such as the ISOPARS G, H, K and L (trade marks) of Exxon and SHELLSOL T (trade mark) of the Shell Oil Company.

To improve or control the chargeability of the dispersed toner particles one or more charge control agents can be added to the toner particle composition.

In contrast with dry toners the liquid-suspended toner particles acquire normally their negative or positive charge from a chemical dissociation reaction on the toner particle surface and the introduction of a charged species in the carrier liquid to form the counterion. The principal charging mechanisms operating with a dissociation reaction are described, e.g., by Robert B. Comizolli et al. in Proceedings of the IEEE, Vol. 60, No. 4, April 1972, p. 363–364.

So, a liquid developer composition for use according to the present invention includes at least one substance (called "charge control" agent or substance), which influences or is responsible for electrical charging of the toner. The charge control substance(s) may have positive or negative charging effect. Mostly oil-soluble inogenic substances (surfactants), e.g., metallic salts of organic acids with long aliphatic chain (e.g. containing at least 6 carbon atoms), are used for that purpose. By predominant adsorption of one ionic species, the toner particles receive a net charge, whose amount can be regulated by changing the additive concentration. In this way the sensitivity of the toner (i.e. deposited mass per surface charge) can be controlled. The polarity can be determined by appropriate choice of the surfactant. For example, a suspension of carbon black in liquid isoparaffins becomes negatively charged by overbased calcium petroleum sulphonate and positively charged by calcium diisopropyl salicylate. Mixtures of different charge control agents can be used. For example, a mixture of different charge control agents having opposite charging effects can be used so that the strength of the charge on the toner or the polarity thereof can be adjusted by varying the ratio between the different agents (see GB-Pat. Nos. 1,411,287; 1,411,537 and 1,411,739). Particularly suitable positively working charge control substances are described in GB-Pat. No. 1,151,141. These charge control agents are bivalent or trivalent metal salts of:

(a) a monoester or diester of an oxyacid derived from phosphorus, (b) an oxyacid derived from phosphorus and containing one or two organic groups linked to the phosphorus atom by a carbon atom, or (c) an oxyacid derived from phosphorus and containing an ester group and an organic group linked by a carbon atom to the phosphorus atom, said organic group being aliphatic, cycloaliphatic, or aromatic.

The organic group preferably comprises a chain of at least 4 carbon atoms, most preferably from 10 to 18 carbon atoms and such chain may be substituted and/or interrupted by hetero-atom(s), e.g. oxygen, sulphur, or nitrogen atom(s).

Particularly good results are obtained with the zinc salts. However, other salts may also be used, e.g. salts of magnesium, calcium, strontium, barium, iron, cobalt, nickel, copper, cadmium, aluminium, or lead.

The solubility in the electrically insulating carrier liquid of such metal salts can be promoted by the presence of one or more organic groups with branched structure, e.g. branched aliphatic groups, such as a 2-butyl-octyl group.

Other particularly suitable positively working charge control agents that are of special interest in the production of an electrophoretic developer with low charge/-toner particle mass ratio are described in U.S. Pat. No. 4,138,351, disclosing developer compositions, which contain as control agent a metal alkyl sulphonate whose metal ion is a bivalent metal ion selected from the group consisting of zinc(II), lead(II), cadmium(II), and copper(II) or is a trivalent metal ion of the group VIII of the Periodic Table of the Elements, e.g. iron(III) or of the group VI B e.g. chromium(III), and in which the sulphonate group is present directly on an alkyl chain containing at least 6 carbon atoms in straight line. A suitable amount of the sulphonate for a given toner developer can easily be determined by simple tests. By using such a metal alkyl sulphonate as charge control agent the specified results can be achieved with toner particles of a size commonly used in the electrophotographic art, e.g., with toner particles sizing in the range of 0.2 $\mu$m to 2 $\mu$m.

Particularly suitable negatively working charge control agents are described in U.S. Pat. No. 4,147,812 disclosing developer compositions, which contain as control agent an oil-soluble overbased alkaline earth metal hydrocarbon sulphonate, whose metal is magnesium, calcium, or barium. Said sulphonate has an average molecular weight of at least 800 and a total base number (TBN) determined according to ASTM D 664-58 of at least 2. A useful amount of these negatively charging substances is in the range of 1 to 40% by weight with respect to the dispersed colouring substance.

A liquid developer composition for use according to the present invention can be prepared by using dispersing and mixing techniques well known in the art. It is conventional to prepare first a blend of colouring matter with the molten thermoplastic resin binder by means of suitable mixing apparatus, e.g. kneading apparatus, extruders or mills. Thereupon, the molten material is cooled down and dispersed in an insulating carrier liquid by means of suitable mixers, e.g. a 3-roll mill, ball mill, colloid mills or high speed stirrers. The concentrate contains e.g. from 15 to 80% by weight of the solid materials. Subsequently further insulating carrier liquid is added to provide a liquid toner composition ready for use in the electrophoretic development process. It is generally suitable for a ready for use electrophoretic liquid developer to incorporate the toner in an amount between 1 g and 20 g per liter, preferably between 2 g and 10 g per liter. The charge controlling substances can be applied as a pre-coating to the pigment particles prior to their use in making up the developer composition or can be introduced as a separate ingredient in the liquid and allowed to adsorb onto the pigment-binder particles.

The electrophoretic development may be carried out by using any known electrophoretic development technique or device. The electrical field of the image to be developed may be influenced by the use of a development electrode. The use of a development electrode is of particular value in the development of continuous tone images. When no development electrode is used, the developed image may exhibit exaggerated density gradients, which may be of interest for certain purposes in graphic arts.

The charge pattern to be developed may be obtained according to any known electrostatographic technique, which includes direct image-wise charging of a dielectric, e.g. by mean of a charged stylus, through photoelectron emission or ionography or image-wise discharging of a photoconductor medium, e.g. a selenium drum or photo-conductive zinc oxide sheet or plate. Toner transfer from a toner image still being wet proceeds e.g. by electrophoresis. A description of this technique is presented in the published German Patent Applications Nos. 2,144,066 and 2,147,646.

The developed images of still wet toner particles may be transferred onto different kinds of supports, e.g. resin, paper, resin coated paper or metal support, e.g. aluminium support, and may serve for the formation of a copy or printing master, e.g. planographic printing plate. For example, the toner image is fixed on an aluminium support that before printing is inked with a greasy or fatty ink in the areas containing fixed toner and wetted with an aqueous damping liquid in the still bare aluminium areas. Planographic aluminium printing plates are made fatty ink-repellent and highly water-accepting in the areas not covered by toner according to known wetting techniques, e.g. by treating the plate carrying the toner image fixed according to the present invention with an aqueous solution containing phosphoric acid. Suitable treating liquids for that purpose are described, e.g. in U.S. Pat. No. 3,300,306.

For heat and pressure fixing a still wet or moist toner image to a sheet or web support, e.g. a paper, resin-coated paper, resin film or metal support, e.g. aluminium sheet, said toner image after being deposited in image configuration on said support is conveyed between means that exert substantially equal pressure on the front and rear side of said support, while heated to least the means directed to the front side and contacting the toner particles is at a temperature sufficient to fuse the toner particles and has a surface with abhesive character thereto.

In a preferred embodiment said toner-image bearing support is conveyed through the nip formed by rollers rotating in opposite direction, wherein the roller contacting the toner image contains a heating source e.g. infra-red radiator or electrical resistance heating element. In most apparatus for providing the necessary pressure a spring pressure mechanism is used actuating the pressure roller which is a support roller contacting the rear side of the toner-image bearing support. An example of a preferably used toner fixing apparatus containing a fuer and pressure roller with self-adjusting pressure mechanism is described in the U.S. Pat. No. 4,269,594. Other roller fusing devices for fixing toner images are provided with a pneumatically operated bladder to apply an equal pressure to all toner image parts. Examples of such devices are disclosed in Research Disclosure September 1981 items 20904, 20906 and 20914.

In an embodiment for carrying out the present heat and pressure fixing process on non-metal supports, e.g. paper supports, the fuser roller consists of a tube in aluminium having e.g. an inner diameter of 40 to 45 mm, a wall thickness of 1 to 2 mm and a length of 230 mm onto which a layer of polytetrafluoro ethylene with a thickness of 20 to 60 μm is provided. Within the tube, and centrally located is provided a 500 to 1000 Watt halogen flood light lamp. This type of lamp enables the fuser roller to attain a surface temperature of about 180° C. in standby position. The pressure roller acting as support roller co-operating with said fuser roller is a solid cylinder of stainless steel, copper or aluminium that may be internally heated and onto which a layer of silicone rubber with a thickness in the range of 3 to 10 mm having a Shore A hardness in the range of 30 to 60 has been applied.

The pressure roller and the heat fuser roller are mounted in contact with each other and the pressure at the area of contact with the toner is adjusted at a value in the range of 1 to 2 kg per cm of the tangent line between the rollers. The tangent line has operating with the above rollers under the above circumstances of pressure a length in the range of 5 to 9 mm. The pressure between the fuser and pressure roller canbe controlled by spring(s) or pneumatically.

According to a preferred embodiment the fuser roller is cleaned with a web, e.g. porous paper web, impregnated with silicone oil.

According to a particularly advantageous embodiment, upstream of the fuser roller a heating element, e.g. in the form of a resistor heated conveyor roller or plate, is arranged to provide some pre-heating whereby the temperature of the fuser roller can be lowered.

According to a special embodiment the pressure in the present heat-and-pressure fixing process is applied with an optionally heated endless belt made e.g. of elastomer or metal coated with elastomer layer.

In an embodiment for carrying out the present heat and pressure fixing process on metal supports, the fuser roller consists of a tube of aluminium having e.g. an inner diameter of 40 to 45 mm, a wall thickness of 1 to 2 mm and a length of 323 mm onto which a layer of silicone rubber with a thickness of 5 mm and having a Shore A thickness in the range of 30–60 is provided. The pressure roller is a tube or aluminium having an inner diameter in the range of 40 to 45 mm, a wall thickness of 10 mm and a length of 323 mm. Both the pressure and fuser roller are provided with a centrally located 900 W quartz lamp and are operated at a surface temperature of e.g. 190° C. The pressure at the area of contact with the toner carrying material is between 2 to 4 kg per cm of the tangent line between the rollers. The contacting zone along the tangent line has a width in the range of 4 to 6 mm. The pressure between the füser and pressure roller is controlled by springs or pneumatically. According to a preferred embodiment the fuser roller is cleaned with a web, e.g. porous paper web, impregnated with silicone oil.

The development process of the present invention allows the fixing of still wet or moist toner images at pass-through speeds between the rollers in the range of 10 to 30 $cm.s^{-1}$, the heating roller temperature being in the range of 115° to 200° C.

In especially preferred embodiments of the invention, at least a substantial part of the carrier liquid is evaporated during the fixing of the still wet toner particles and is carried off by suction or pressurized entrainer gas and led to a station wherein it is accumulated out of contact from the environment and burned for the production of non-toxic products, for example water and carbon dioxide. This has the advantage of reducing or preventing the pollution of the ambient atmosphere with carrier vapour or decomposition products which may be toxic or inflammable.

An apparatus whereby such pollution is prevented in the fixing of an electrophoretically developed toner image carried by a web support, is characterised in that it comprises means for feeding such a web along a path between the nip of a pair of pressure exerting rollers, means for heating at least one of those rollers, and means for aspirating vapour away from the region of the nip of those vapours into a conduit, keeping the vapour away from the atmosphere.

Figure 2:
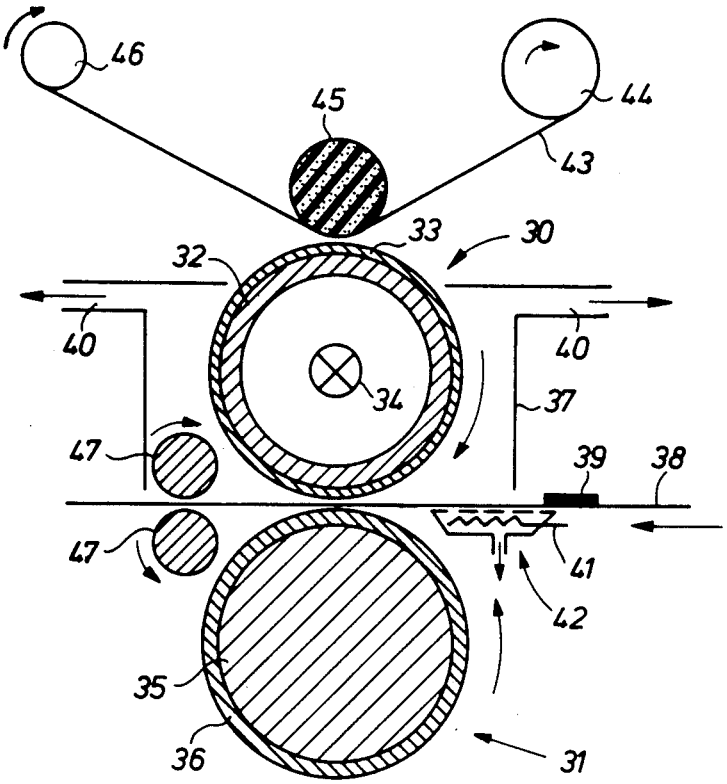

The invention will now be described in greater detail and by way of Example with reference to the accompanying diagrammatic drawings in which FIG. 1 is a sectional view of a first embodiment of a heat-and-pressure roller fixing device suitable for use in performing a process according to this invention, and FIG. 2 is a sectional view of a second embodiment of such a heat-and-pressure roller fixing device.

FIG. 1 is a diagrammatic sectional drawing of a heat-and-pressure roller fixing device comprising an internally heated fuser roller 1 and a pressure roller 2 which is a solid aluminium cylinder 19 coated with a layer of silicone rubber 20. The fuser roller 1 consisting of an aluminium drum 3 coated with a thin layer 4 of polytetrafluoroethylene and having inside a tubular halogen lamp 5 is located in a cap-shaped housing 6 that has an outlet 7 wherethrough the carrier liquid vapour swept along, i.e. entrained, with an air stream leaves the fixing device. The rim 8 of the cap-shaped housing 6 forms a small gap with the image support 9, e.g. paper sheet, carrying the toner image portions 10 to be fixed. By applying air-pressure at the intake 11 of cap-shaped housing 12 and/or reduced pressure at the outlet 7 of cap-shaped housing 6 air is forced to enter housing 12 that covers housing 6. Opposite the rim 13 of housing 12 conveyor rollers 14 contact the rear of support 9. Operating that way air pressure urges the support 9 against said conveyor rollers 14 and some of the pressurized air escapes from housing 12 before entering housing 6, so that the support 9 can move freely without touching the rims 8 and 13 of the housings 6 and 12 respectively. Consequently no smearing of the toner image can take place. The vapour of carrier liquid leaving the exhaust 7 of the housing 6 is removed and kept out of the atmosphere by different measures, e.g.:

(1) by adsorption and/or absorption, e.g. in a column containing an adsorbent such as activated carbon or a high boiling absorbing solvent;

(2) by condensation in a cooler, e.g. mini-refrigerator, or (3) by combustion, e.g. by burning it catalytically as described in U.S. Pat. No. 4,538,899 to produce only water vapour and carbon dioxide when using hydrocarbons as carrier liquid.

The pressure roller 2 is moistened with silicone oil 15 and transfers that oil in the period inbetween the pass-through of two successive paper sheets 9 onto the fuser roller 1. The silicone oil 15 is sucked up in a felt wick 16 braced on a curved support element 17 in a container 18.

FIG. 2 is a diagrammatic sectional drawing of a heat-and-pressure fixing device comprising an internally heated fuser roller 30 and a pressure roller 31 formed of a solid aluminium cylinder 35 coated with a layer 36 of silicone rubber. The fuser roller 30 consists of an aluminium drum 32 coated with a thin layer 33 of polytetrafluoroethylene. A cap 37 covers the nip formed by the fuser roller 30 and the paper sheet 38 carrying toner image portions 39 to be fixed. Suction applied to the exhaust openings 40 of said cap 37 takes away vaporized carrier liquid and introduces it into an absorption column (not shown in the drawing). A resistor 41 heats suction plate 42 which keeps flat the paper sheet 38 and provides some pre-heating. In order to prevent toner offsetting as much as possible, the fuser roller 30 is kept wetted with silicone oil applied from a cleaning web 43. The cleaning web 43 being delivered from a supply roller 44 is pressed against the fuser roller 30 with a resilient guiding roller 45 and thereupon stored on a take-up roller 46. Conveyor rollers 47 guide the paper support 38 into a receiving tray (not shown in the drawing).

According to a particular interesting embodiment to prevent toner offsetting on the heating or fuser roller the at least a part, e.g. from 1 to 5% by volume, of the hydrocarbon liquid serving as carrier liquid for the toner particles has been replaced by silicone oil.

The following examples illustrate the process of the present invention operating with useful toner compositions presented in comparative tests without however limiting it thereto. The ratios and percentages are by weight unless otherwise indicated.

EXAMPLE 1

Preparation of the liquid toner developer with positively charged toner particles.

200 g of the styrene-allyl alcohol copolymer RJ 100 (trade name) resin (average molecular weight 1600) and 100 g of PRINTEX G carbon black (trade name) were introduced in a kneading apparatus type LILIPUT 030 C.N. (trade name) sold by Meill (Switzerland).

The kneading apparatus was heated with circulating silicone oil at 110° C. till the temperature of the kneaded mass reached 90° C. After 2 h of kneading, the mass was cooled, broken, and ground in a grinding apparatus IKA model A 10 (sold by Janke & Kunkel, W. Germany) so as to obtain a fine powder of carbon black precoated with RJ 100 resin having a particle diameter of about 50 to 100 μm.

A concentrated liquid toner developer was prepared by milling the following ingredients for 15 h in a vibratory ball mill:

42 g of carbon black precoated with RJ 100 (trade name) resin 42 g of a 30% by weight solution of NEOCRYL B 702 (trade name) in ISOPAR G (trade name of Exxon for an aliphatic hydrocarbon having a boiling range of 160°-175° C. and a Kauri-butanol (KB) value of 27)

14 ml of a 2% (weight/volume) solution of zinc mono-2-butyl-octyl phosphate in isododecane 150 ml of isododecane.

The above toner had a particle diameter of 0.40 μm and a very good stability and shelf-life in the toner concentrate form as well as in the development concentration.

7.5 ml of the above concentrated liquid toner developer were diluted with 1 liter of ISOPAR G (trade name) hereby obtaining a stable positive working electrophoretic developer.

The meltviscosity of the separated and dried toner particles measured at 120° C. as described hereinbefore was 1400 Pa.s.

Development and Transfer

An electrostatic image formed on a conventional electrophotographic recording element, i.e. paper coated with photoconductive zinc oxide dispersed in a resinous binder, which was negatively charged and image-wise exposed to light, was developed with the diluted toner developer obtained.

The transfer of the electrophoretically deposited toner proceeded by applying a negative voltage of 3 kV to a metal roll, which was kept in close ohmic contact with the rear side of a paper sheet acting as receiving material whose front side was therefore kept in close contact with the wet image on the photoconductor.

Fixation

After toner transfer by electrophoresis the image-wise deposited toner particles while being still wet were fed to a heat-and-pressure roller fixing device as illustrated in FIG. 2.

In said device the fuser roller consists of a tube in stainless steel or brass having an inner diameter of 41 mm, a wall thickness of 1.2 mm and a length of 230 mm onto which a layer of silicone rubber with a thickness of 1.0 mm is provided. Within the tube, and centrally located is provided a 1000 Watt halogen flood light lamp. This lamp enables the fuser roller to attain a surface temperature of 210° C. in standby position. The pressure roller acting as support roller co-operating with said fuser roller is a solid cylinder of stainless steel onto which a layer of silicone rubber with a thickness of 7 mm is provided. The diameter of the roller is 44 mm.

The pressure roller and the heat fuser roller are mounted in contact with each other and the pressure at the area of contact with the toner is adjusted at a value of 1.0 kg per cm tangent line between the rollers.

The pass-through speed of the receiving paper carrying the toner image was 10 cm/s and the surface temperature of the heating roller was 180° C.

For the assessment of the degree of fixation a "tape test" was carried out. In the tape test an adhesive tape is pressed with the same pressure (about 300 kg/sq.m) onto the fixed toner image and is removed in the different tests at the same tearing angle and speed from the image. In function of the amount of toner transferred to the adhesive surface the fixing is given a rating number. Zero stands for excellent toner fixation. Larger numbers stand for decreasing fixing adherence and worsening results.

A fixed toner image with high rub-resistance (high fixation adherence) was obtained which was proved by the above tape-test giving a fixation rating value 0. The fixed toner image had a non-reflective appearance and diffuse optical density of 1.25.

In order to evaluate the degree of toner off-setting on the fuser roller, the fuser roller was cleaned with a siliconized paper cleaning web making contact with the upper part of the fuser roller over a length of 1 cm. The increase of optical density (ΔD) on said web is a measure for the degree of toner offsetting. An increase in optical density smaller than 0.2 is still acceptable and poses no problems in effective cleaning of the fuser roller.

The evolution of the degree of fixation of toner particles of different meltviscosity expressed in Pa.s and different pigment to binder ratio (P/B) in function of different fixing temperatures (140°-160°-180° and 200°

C.) is given in the following Tables 2 and 3 respectively.

TABLE 2

| Test | Pa.s | Rating number | Fixing temperature °C. |
|---|---|---|---|
| 1 | 65,000 | 3 | 140 |
| | | 2 | 160 |
| | | 1 | 180 |
| | | 0 | 200 |
| 2 | 6750 | 3 | 140 |
| | | 2 | 160 |
| | | 1 | 180 |
| | | 0 | 200 |
| 3 | 4580 | 3 | 140 |
| | | 2 | 160 |
| | | 1 | 180 |
| | | 0 | 200 |
| 4 | 3880 | 3 | 140 |
| | | 2 | 160 |
| | | 0 | 180 |
| | | 0 | 200 |
| 5 | 1400 | 3 | 140 |
| | | 1 | 160 |
| | | 0 | 180 |
| | | 0 | 200 |
| 6 | 607 | 1 | 140 |
| | | 0 | 160 |
| | | 0 | 180 |
| | | 0 | 200 |

TABLE 3

| Test | P/B | ΔD | Fixing temperature °C. |
|---|---|---|---|
| 1 | 1/1 | 0.02 | 140 |
| | | 0.05 | 160 |
| | | 0.06 | 180 |
| | | 0.04 | 200 |
| 2 | 1/1.4 | 0.03 | 140 |
| | | 0.07 | 160 |
| | | 0.06 | 180 |
| | | 0.06 | 200 |
| 3 | 1/1.6 | 0.04 | 140 |
| | | 0.10 | 160 |
| | | 0.06 | 180 |
| | | 0.10 | 200 |
| 4 | 1/1.8 | 0.05 | 140 |
| | | 0.06 | 160 |
| | | 0.09 | 180 |
| | | 0.09 | 200 |
| 5 | 1/2 | 0.13 | 140 |
| | | 0.17 | 160 |
| | | 0.12 | 180 |
| | | 0.13 | 200 |
| 6 | 1/5 | 0.18 | 140 |
| | | 0.19 | 160 |
| | | 0.20 | 180 |
| | | 0.25 | 200 |

EXAMPLE 2

With the toner composition of test 1 of Example 1 different pass-through speeds at different temperatures were combined. Table 4 contains the rating numbers of the tape-tests and the ΔD values obtained as a measure of toner off-setting under the described conditions of temperature and pass-through speed.

TABLE 4

| Pass-through speed cm/s | ΔD | Rating numbers | Fixing temperature °C. |
|---|---|---|---|
| 3.8 | 0.09 | 1 | 140 |
| | 0.13 | 0 | 160 |
| | 0.12 | 0 | 180 |
| 10.3 | 0.13 | 3 | 140 |
| | 0.17 | 2 | 160 |
| | 0.12 | 0 | 180 |

TABLE 4-continued

| Pass-through speed cm/s | ΔD | Rating numbers | Fixing temperature °C. |
|---|---|---|---|
| | 0.13 | 0 | 200 |
| 28.0 | 0.15 | 4 | 140 |

EXAMPLE 3

With the toner composition of test 5 of Example 1 a wet toner image was formed on an aluminium anodized plate. The fixation was performed on a heat and roller pressure fixing device wherein the fuser roller was an aluminium tube having an inner diameter of 41 mm, a wall thickness of 2 mm and a length of 323 mm. The tube was coated with a layer of silicone rubber with a thickness of 5 mm and a shore hardness of 40. Within said tube a 900 W quartz lamp was located centrally. The pressure roller acting as support roller cooperating with said fuser roller was an aluminium cylinder with a diameter of 41 mm and a well thickness of 10 mm. The pressure roller was equipped with a same heating element as described for the fuser roller. The pressure roller and fuser roller were mounted in contact with each other and the area of contact was adjusted so as to obtain a pressure of 3 kg per cm of the tangent line providing a contact zone along the tangent line of a width of 5 mm.

The pass-through speed of the aluminium plate carrying the toner image was 5 cm/s and the surface temperature of both rollers was 190° C. The heat and pressure fixing device was equipped with a silicone cleaning web as illustrated in FIG. 2.

An excellent rub-resistant fixing proved by the already defined tape test and absence of hot toner offset was obtained.

We claim:

1. In a process of image production which comprises the steps of developing an electrostatic charge pattern with toner particles comprised of colouring matter in a thermoplastic resin binder and dispersed in a carrier liquid and fixing of said pattern-wise deposited toner particles while still damp with said carrier liquid on a support by simultaneously subjecting the same to heat and pressure, the improvement wherein said toner particles have at 120° C. a melt viscosity when dry of from 500 to 100,000 Pa.s, a mean average diameter of from 0.1 to 5 μm, and a ratio of colouring matter to resin binder of from 1/1 to 1/9 by weight.

2. Process according to claim 1, wherein the colouring matter is dissolved or dispersed in a binder essentially consisting of at least one thermoplastic polymer.

3. Process according to claim 2, wherein said polymer is selected from the group consisting of thermoplastic polyallyl resins, polyvinyl resins, polyalkylenes, polysiloxane resins, and polyester resins, said resins having a melting temperature in the range of 90° C. to 150° C.

4. Process according to claim 3, wherein the polymer is a styrene-allyl alcohol copolymer.

5. Process according to claim 1, wherein the carrier liquid is a hydrocarbon liquid containing from 1 to 5% by volume of silicone oil.

6. Process according to claim 1, wherein for heat-and-pressure fixing the toner image bearing support is conveyed through the nip formed by rollers rotating in opposite direction and at least the roller contacting the toner image contains a heating source.

7. Process according to claim 6, wherein the other roller also contains a heating source.

8. Process according to claim 6, wherein each of said fuser and pressure rollers is provided with a surface coating of polytetrafluoroethylene or silicone rubber.

9. Process according to claim 6, wherein pressure between said rollers is built up by spring or air pressure.

10. Process according to claim 6, wherein the fuser roller is cleaned with a web impregnated with silicone oil.

11. Process according to claim 1, wherein the support carrying the toner image is a paper, resin coated paper, resin film or metal support.

12. A process according to claim 1, wherein at least a substantial part of the carrier liquid is evaporated during the fixing of the damp toner particles and is aspirated away from said support and led to a disposal station.

13. Process according to claim 12, wherein the carrier liquid vapour is removed and kept out of the atmosphere by adsorption and/or absorption or by condensation in a cooler.

14. Process according to claim 1, wherein before being subject to said heat-and-pressure, the damp toner particles are pre-heated.

* * * * *

UNITED STATES PATENT AND TRADEMARK OFFICE

CERTIFICATE OF CORRECTION

PATENT NO. : 4,842,972

DATED : June 27, 1989

INVENTOR(S) : Serge M. Tavernier et al

It is certified that error appears in the above-identified patent and that said Letters Patent is hereby corrected as shown below:

In the Claims:

Claim 1 should read as follows:

-- 1. In a process of image production which comprises the steps of a) developing an electrostatic charge pattern with toner particles of a thermoplastic resin with coloring matter distributed therethrough which particles are dispersed in a carrier liquid and b) fixing of said pattern-wise deposited toner particles while still damp with said carrier liquid on a support by passing said support with the toner particle patterns therein through the nip of a pair of opposed rollers biased together at a pressure of about 1-2 kg per cm of the tangent line at said nip while simultaneously subjecting the particles of said pattern to heat to adhere said resin particles to said support, the improvement wherein said toner particles have at 120°C a melt viscosity when dry of from 500 to 100,000 Pa.s, a mean average diameter of from 0.1 to 5 um, and a ratio of colouring matter to resin binder of from 1/1 to 1/9 by weight. --.

Claim 6 should read as follows:

-- Process according to claim 1, wherein at least the roller of said pair contacting the toner image contains a heating source. --.

UNITED STATES PATENT AND TRADEMARK OFFICE

CERTIFICATE OF CORRECTION

PATENT NO. : 4,842,972

DATED : June 27, 1989

INVENTOR(S) : Serge M. Tavernier et al

It is certified that error appears in the above-identified patent and that said Letters Patent is hereby corrected as shown below:

In the Claims:

Claim 8, line 2, "fuser and pressure" should be deleted.

Claim 10, line 1, "the fuser" should read -- said one --.

Claim 14, line 2, "subject" should read -- subjected --.

Signed and Sealed this

Tenth Day of April, 1990

*Attest:*

HARRY F. MANBECK, JR.

*Attesting Officer*

*Commissioner of Patents and Trademarks*